United States Patent [19]

Maisonneuve

[11] 4,212,386

[45] Jul. 15, 1980

[54] CIGARETTE CASE

[76] Inventor: Leo Maisonneuve, 4480 N. 40th St., St. Petersburg, Fla. 33714

[21] Appl. No.: 953,548

[22] Filed: Oct. 23, 1978

Related U.S. Application Data

[63] Continuation of Ser. No. 832,086, Sep. 12, 1977, abandoned.

[51] Int. Cl.[2] ..... A45C 11/00

[52] U.S. Cl. ..... 206/37; 206/527; 220/4 B; 220/346; 220/347

[58] Field of Search ..... 206/165, 37, 261–263, 206/265–267, 525, 527, 537; 220/4 B, 4 E, 322, 325–327, 345–347

[56] References Cited

U.S. PATENT DOCUMENTS

| | | | |
|---|---|---|---|
| 1,683,603 | 9/1928 | Canfield | 220/4 B |
| 2,012,033 | 8/1935 | Atwater et al. | 206/267 |
| 2,631,750 | 3/1953 | Laucks | 220/326 X |
| 3,077,281 | 2/1963 | Braverman | 220/4 E |

FOREIGN PATENT DOCUMENTS

| | | | |
|---|---|---|---|
| 419697 | 3/1967 | Switzerland | 206/267 |
| 477064 | 3/1976 | U.S.S.R. | 220/4 B |

*Primary Examiner*—Herbert F. Ross
*Attorney, Agent, or Firm*—Arthur W. Fisher, III

[57] ABSTRACT

A novelty device comprising an upper and lower member detachably coupled together by a clasp fixedly attached to the upper member wherein the upper and lower member cooperatively form an enclosure to hold an object such as a cigarette therein. The upper and lower member are specifically configured to cooperatively form a guide including an alignment structure to facilitate the opening and closing of the enclosure.

3 Claims, 4 Drawing Figures

CIGARETTE CASE

This application is a continuation of Ser. No. 832,086, filed Sept. 12, 1977, now abandoned.

BACKGROUND OF THE INVENTION

1. Field the Invention

A novelty device comprising an enclosure configured to hold a cigarette or the like.

2. Description of the Prior Art

A number of efforts have been made to deter or stop smoking in similar bad habits. Examples of these are reflected in a number of patents. For example, U.S. Pat. No. 2,649,752 relates to cigarette cases or the like. Although capable of application to container comprising hinged sections including a receptacle body and a cover with clock dials on the inner and outer sides of the latter and time indicating pointers or hands connected to a common axis at the center of the dials to swing or move over the dials as means of disciplining oneself by setting the clock hands from the inside each time a cigarette is smoked. Once the time is set, the clock will act as a warning against smoking until the time has lapsed. U.S. Pat. No. 2,812,851 relates to another cigarette case having a time-controlled means for permitting access thereto upon the lapse of a predetermined interval of time. U.S. Pat. No. 3,424,123 shows a cigarette case having a first compartment to accommodate a plurality of cigarettes which are always available to the user, and a second compartment enclosing a timing mechanism and an audible signal control knob to be manually set to any desired time interval. U.S. Pat. No. 3,655,325 discloses a pseudo-cigarette package that produces simulated coughing sounds when the package is picked up by a potential user to remove the cigarette therefrom. The simulated noises are reproduced from a battery-driven recording player through a miniature loudspeaker in the package.

Additional examples are shown in U.S. Pat. Nos. 3,951,357 and 3,034,639. Also a music coffin cigarette-like box in shown in the December 1967 issue of House and Garden page 83.

Close examination of these does not show the unique structure and alignment means and clasp means as shown and defined in applicant's invention.

SUMMARY OF THE INVENTION

The present invention relates to a self aligning, self-locking novelty device comprising an upper and lower member cooperatively forming an enclosure. The enclosure or box is specifically designed and configured for carrying on the person in a shirt pocket for use in breaking bad habits such as smoking habit. With this specific purpose, the box or enclosure permits the user to place a cigarette therein as a pyschological means of "killing" the habit. To break similar habits one need merely place an image remainder which symbolizes the habit such as a photograph or note reminding one of a bad habit which the person is bent on breaking.

More specifically the enclosure comprises an upper member including an upper guide formed on the inner portion thereof and a lower member including a lower guide which are disposed to cooperatively engage each other as an alignment means to align the upper and lower member during the assembly and disassembly thereof. The novelty device further includes a stop means comprising a projection formed on the forward portion of the upper guide and a corresponding detent formed on the lower member to cooperatively engage each other and limit the relative movement therebetween when in assembled form. The novelty device further includes an opening means comprising a downwardly projecting key formed on the rear portion of the upper guide and a second key projecting upperwardly from the lower guide to cooperatively engage each other when the upper member is moved forward relative to lower member camming the upper and lower members away from each other to permit opening of the enclosure by sliding the upper member forward relative to the lower member.

A clasp comprising a substantially flexible clip extending from the upper member over the top of the enclosure over the lower member approximately half the length thereof. The pressure clip or clasp on the upper member holds the upper member firmly to the lower member and also serves as a clip when inserting over the outside of a pocket thus securing the novelty device inside the pocket much as clip or clasp of an eyeglass case.

In operation an object is placed in the lower member. Then the upper member is slid onto the lower member by means of the alignment means such that the clasp extends over the forward portion of the lower member exerting pressure between the upper and lower member. The upper member is moved continuously until the stop means operatively engage each other where the novelty device is completely closed. In order to open, the process or operation is reversed such that the opening means engages each other in sliding engagement to separate the upper and lower member from each other as the upper member is moved forward relative to the lower member.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several view of the drawings.

DETAILED DESCRIPTION OF THE PREFERRED EMBODIMENT

Figure 1:
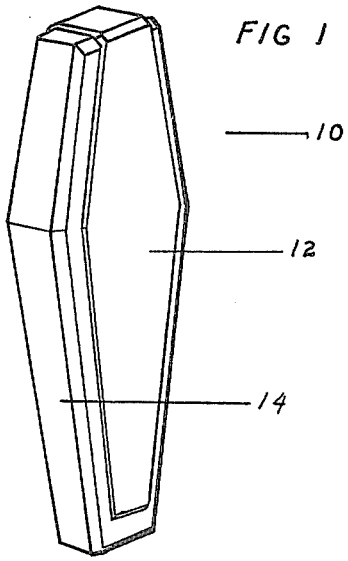
FIG. 1 is a perspective view of the novelty device.
Figure 3:
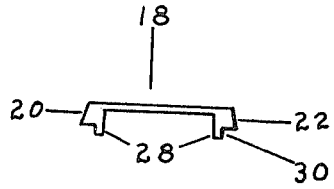
FIG. 3 is an exploited end view of the novelty device.
Figure 3:
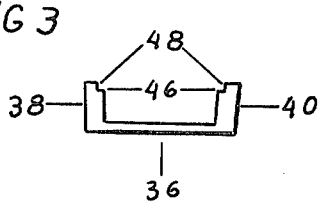
Figure 2:
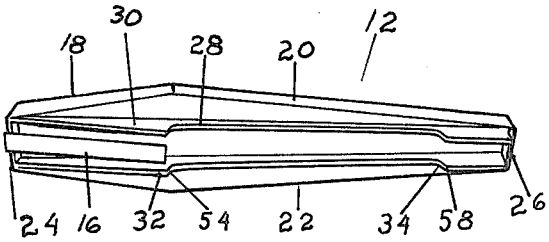
FIG. 2 is an exploded view of the novelty device.

As best shown in FIGS. 1 and 2, the present invention relates to a novelty device comprising an enclosure generally indicated as 10 cooperatively formed by an upper member 12 and a lower member 14. As more fully described hereinafter, when assembled the upper member 12 and lower member 14 are operatively coupled together by a clasp 16.

The enclosure or box 10 is specifically designed and configured for carrying on the person for use in breaking bad habits such as the smoking habit. With this specific purpose, the box or enclosure permits the user to place a cigarette therein as a pyschological means of "killing" the habit. The enclosure is small and light weight to carry on the person in the shirt pocket or the like as a reminder of the bad habit. To break similar habits one need merely place an image reminder such as a photograph or note reminding one of a bad habit which the person wishes to break.

As best shown in FIG. 2, the upper member 12 comprises a top 18, sides 20 and 22 together with front and rear elements 24 and 26 respectively. Extending downwardly from the inside of top 18 is a pair of ridges each indicated as 28 extending along the longitudinal axis of the upper member 12. As more fully described hereinafter, the ridges 28 comprise an upper guide, an upper stop and an upper opening element generally indicated as 30, 32 and 34 respectively. The lower member 14 comprises bottom 36, sides 38 and 40, and front and rear elements' 42 and 44. The lower member 14 includes a pair of ledges 46 extending in substantially parallel relationship relative to one another along the longitudinal axis of the lower member 14. The ledges 46 comprise a lower guide, a lower stop, and a lower opening element 48, 50 and 52 respectively. The upper and lower guides 30 amd 48 are disposed relative to each other such that the forward portion of the ridge 28 and ledge 46 cooperatively form an alignment means to maintain lateral alignment of the upper member 12 and lower member 14. The lateral alignment is achieved by the outside edges of the ridges 28 (upper guides 30) sliding along, and held in lateral alignment by the upright face lower guide 48), against which the ledge 46 is affixed.

The upper stop 32 comprises a key-like element 54 formed along the forward portion of the ridge 28 which cooperatively engages the lower stop 50 comprises a detent 56 formed on the forward portion of the ledge 46 cooperatively forming a stop means to maintain the longitudinal alignment of the upper and lower elements 12 to 14 during assembly and disassembly of the novelty device 10. The upper and lower opening elements 34 and 52 comprise an opening means including a first and second key 58 and 60 respectively formed on the rear portion of the ridge 28 and ledge 46 respectively to form a camming effect as more fully described hereinafter.

Figure 4:
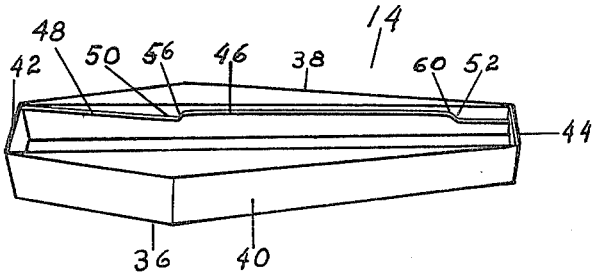
FIG. 4 is a side view of the novelty device.
Figure 4:
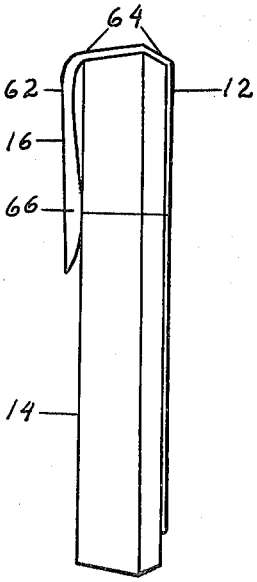

As best shown in FIG. 4, the clasp 16 comprises a substantially flexible member 62 fixedly attached to the upper member 12 and having a substantially U-shaped element 64 to extend over the end portion of the novelty device 10 and downwardly along the outer surface of the lower member 14. The clasp 16 includes the clip 66 which engages the lower member 14 coincident with the stop means to lock the upper and lower members 12 and 14 together when fully assembled.

In operation an object is placed in the lower member 14. Then the upper member 12 is slid onto the lower member 14 that the clasp 16 extends over the forward portion of the lower member 14 exerting pressure between the upper and lower member 12 and 14 respectively. The upper member 12 is moved continuously until the upper and lower stops 32 and 50 operatively engage each other when the novelty device 10 is completely closed. In order to open, the process or operation is reversed such that upper and lower opening elements 34 and 52 engage each other in sliding engagement to separate the upper and lower member 12 and 14 from each other as the upper member 12 is moved forward relative to the lower member 14. In this fashion the object within the novelty device 10 is not disturbed or struck by opening or closing.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A novelty device configured to hold a single cigarette or the like, said novelty device comprising an elongated upper and an elongated lower member detachably coupled together by a clasp means attached to said upper member and a guide means comprising an alignment means comprising at least one ridge including a forward and rear portion formed on said upper member and extending substantially the length thereof and a corresponding ledge including a forward and rear portion formed on said lower member and extending substantially the length thereof disposed to operatively engage each other in sliding relation to maintain lateral alignment of said upper member relative to said lower member during assembly and disassembly of said novelty device and a stop means to position said upper member relative to said lower member longitudinally when assembled, said clasp means comprises a substantially flexible member fixedly attached to said upper member having a substantially U-shaped element to extend over one end of said upper member and said lower member, said stop means comprises a key-like element formed along said forward portion of said ridge and a corresponding lower stop means comprises a detent formed on said forward portion of said ledge to maintain said longitudinal alignment of said upper member relative to said lower member, said guide means further including an opening means formed on said rear portion of said ridge and said ledge to facilitate the opening of said upper member relative to said lower member, said opening means comprising an upper opening element including a first key formed on said rear portion of said ridge and a lower opening element including a second key formed on said rear portion of said ledge, said upper and lower opening elements disposed to operatively engage each other in camming relationship to lift said elongated upper member relative to said elongated lower member during the opening of said upper member relative to said lower member.

2. The novelty device of claim 1 wherein the substantially U-shaped element terminates at a point substantially coincident with said stop means to lock said upper and said lower members together when said novelty device is fully assembled.

3. The novelty device of claim 1 wherein said guide means comprises a pair of ridges and corresponding ledges disposed on opposite sides of said upper and lower members respectively.

* * * * *